United States Patent [19]

Marzo

[11] 3,984,108

[45] Oct. 5, 1976

[54] MATHEMATICAL COMPUTATION GAME

[76] Inventor: Edward C. Marzo, 115 Pheasant Road, Spartanburg, S.C. 29302

[22] Filed: Feb. 20, 1975

[21] Appl. No.: 551,254

[52] U.S. Cl. ..... 273/135 B; 35/31 F; 35/31 G; 35/70

[51] Int. Cl.[2] ..... A63F 9/18

[58] Field of Search ..... 35/31 F, 31 D, 31 G, 35/70; 273/135 B, 152.7 R, 135 R

[56] References Cited

UNITED STATES PATENTS

| | | | |
|---|---|---|---|
| 2,769,640 | 11/1956 | Elder | 35/31 G |
| 3,545,101 | 12/1970 | Fike | 273/135 B |
| 3,633,914 | 1/1972 | Solomon | 273/135 B |
| 3,777,415 | 12/1973 | Gariety et al. | 35/31 F |

*Primary Examiner*—Richard C. Pinkham
*Assistant Examiner*—Harry G. Strappello
*Attorney, Agent, or Firm*—Wellington M. Manning, Jr.

[57] ABSTRACT

A mathematical computation game is disclosed. Participants strive to develop a particular mathematical equation within a certain time limit or competitively against other participants. Results are always provided in combination with at least certain numbers and/or mathematical operators. An instructional director, such as a card or the like, will display at least one predetermined result which may or may not be accompanied by a particular point value. Utilizing random or preselected numbers, and all or preselected mathematical operators, participants attempt to create mathematical equations that yield the predetermined results.

4 Claims, 6 Drawing Figures

MATHEMATICAL COMPUTATION GAME

BACKGROUND OF THE INVENTION

Numerous games based around numerology, mathematics and the like have heretofore been developed. Such games have normally included a deck of cards, or the like that display numbers and/or operators that are used to develop a mathematical equation. Mathematical bingo games have been devised where elements having particular numbers thereon may be arranged in such a manner that, when coupled with mathematical operators, they achieve a score in a vertical, horizontal or diagonal alignment. Further, mathematical games have been developed that are similar to the word game, Scrabble, where elements having numbers impressed therein are utilized to coordinate with the particular operators of a certain direction and provide a mathematical equation. Numerous card and related games have also been developed where mathematics is the basis of play and where cards or the like are utilized having numbers and/or mathematical operators displayed on the individual cards.

The present invention represents an improvement over the prior art games represented by the above descriptions. With certain ground rules as alluded to hereinafter, the game of the present invention may be played with a variety of different objectives. Participants may seek to achieve a high gross score; may seek to compete directly against all other participants on a time basis; may compete against a time basis per se, and the like. The subject invention provides a game that is quite entertaining and educational to the participant as well as assisting to develop a participant's mind in mathematical computation techniques.

The prior art does not teach or suggest the present invention. Illustrative of the prior art are the following U.S. Patents: 1,583,223 to Cooke; 1,598,450 to Ritter et al; 1,638,433 to Copeland; 1,652,979 to Francke; 1,699,629 to Phifer; 1,766,465 to Snelling; 2,198,670 to Johnson; 2,565,702 to Stinson; 2,743,108 to Sanders; 2,801,855 to Clay et al; 2,811,360 to Cohen; 3,192,650 to Torchia; 3,514,873 to Stobbe; 3,523,377 to Gardner; 3,649,023 to Schohn; 3,663,021 to Whippo; 3,708,169 to Hoy; 3,733,153 to Van Es; 3,758,962 to Bagdasar and 3,844,568 to Armstrong.

SUMMARY OF THE INVENTION

It is an object of the present invention to provide a novel mathematical, computation game.

Another object of the present invention is to provide a mathematical computation game where results are provided and the participants seek to derive mathematical equations that yield the known results.

Another object of the present invention is to provide a novel number game in the form of a cross number puzzle.

Generally speaking, the mathematical computation game of the present invention comprises at least one instructional director means, said director means having arithmetic operators set forth thereon, said director further displaying at least one result that may be mathematically sought when using the said operators in conjunction with a group of numbers of preferably a value of ten or less each, whereby a participant forming an equation from said numbers and said operators to yield said at least one predetermined result is awarded a point value therefor.

More specifically, in the context of the present invention, predetermined results are always provided. Such predetermined results may have been selected by computer or otherwise, as being a definite solution possibility with certain numbers and operators. Likewise, the results may have been selected at random, whereby a possibility exists that with certain numbers and operators the particular result is impossible. In conjunction with the predetermined results, participants are provided with at least a group of mathematical operators to instruct performance of the various mathematical functions such as addition, subtraction, multiplication and division. Hence, using a random selection of a group of numbers or a predetermined selection of a group of numbers, each of which preferably has a number value of ten or less, a participant may arrange the numbers with the mathematical operators to produce a mathematical equation having as an answer, one of the known results.

As mentioned above, the particular playing rules may vary to determine the winner of the game. For example, each of the predetermined results may be accompanied with a particular point value. A participant can then select the particular resultpoint value combination that he wishes to attempt. Generally, a more difficult result would carry a higher point value than a less difficult result. Participants may then proceed through a plurality of rounds with the highest point value after all the rounds being declared the winner, or until a predetermined winning score has been achieved. Similarly, each round may be based on the time of solution with only the first completion being awarded a point value or with the elapsed time determining the point value for each participant. Other rules are also possible and the ones mentioned above are by way of illustration only.

A further variation of the game of the present invention employs a series of horizontal and vertically aligned squares in row form. Results are predetermined and set forth on alternate horizontal and vertical rows. Certain of the squares are obliterated as in a crossword puzzle. In preselected blanks, mathematical operators or numbers may have been inserted or assigned thereto. Equipped with a random or preselected group of small numbers and mathematical operators, a participant may attempt to derive mathematical equations whose answers correspond to those provided in both the horizontal and vertical directions.

Each of the variations of the game of the present invention may be played with a minimum of equipment. For example, once the needed information is provided on an instructional director, which may be card or some type mechanical device that displays the desired information, the objectives of the game may be accomplished as desired. Equations may be derived mentally, on paper, using elements, cards or the like that have numbers or operators presented thereon, or the like. Game boards may be used if desired with appropriate areas to receive elements.

DESCRIPTION OF THE PREFERRED EMBODIMENTS

Referring to the Figures, preferred embodiments of the present invention will be described in detail. The game of the present invention is directed to persons having an ability to make mathematical computations using generally small numbers, preferably those having a value of ten or under. As will be explained in more detail hereinafter, the present game may involve the use of substantial equipment, or may be played using only instructional materials and a pad and pencil or only the mental faculties.

A group of preferably four or five numbers, each of which is preferably ten or smaller in value, is preselected by a random or some calculated basis. An instructional director means is provided that displays at least one result to be sought by mathematical computation, using all the preselected numbers in conjunction with all the mathematical operators that are also provided. Depending upon the rules of the particular game, different objectives may be sought. For example, all participants may work against a time clock with each being rewarded a point value dependent upon his computation during the elapsed time. Also, participants may compete head to head with only the first successful computation having a point value. With different point values being provided with different results, the degree of difficulty of the selected result could determine the point value awarded. Generally the game, regardless of the overall objectives, would be played in "rounds". A "round" may be based on a time period, a single computation or the like. Further, each total game could consist of a certain elapsed total time, e.g., one hour; a particular number of rounds, e.g., ten; or a preset point total, e.g., 100.

Each participant is preferably provided with a full set of number elements which contains elements, numbered, for example, 1, 2, 3, 4, 5, 6, 7, 8, 9 and 10. Additionally, each participant is provided with a set of operator pieces which preferably includes two plus sign operators, two minus sign operators, two multiplication sign operators, and one division sign operator. Further apparatus that may be employed are paper and a writing implement. Once the instructional director provides the intended result or results, the participants may begin to orient the array of selected numbers and operators to achieve a mathematical equation that yields the selected or predetermined result. Number elements and operator pieces may be intermixed to demonstrate the equation. In view of the three or four different operations that may be employed, a scratch pad is also preferably provided which permits a participant properly to consider the various parameters of computation along the equation. Preferably, a given equation will be accepted only for the first participant to claim it, other participants being ineligible to claim that equation.

Figure 1:
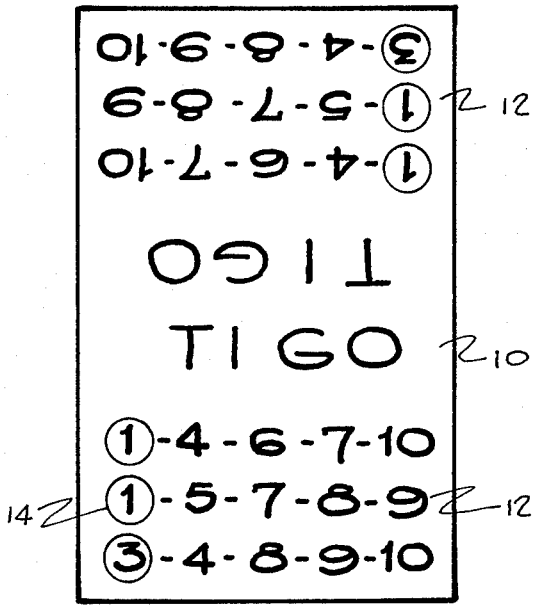
FIG. 1 is an illustration of a playing card type instructional director according to the present invention.

Many devices may be suitably provided to serve as an instructional director means and thus properly display at least one result and an array of mathematical operators. A card system is preferred where both results and operators are printed on the individual cards of a deck. As can be seen in the Figures with particular reference to FIGS. 1 and 2, other information may likewise be printed or displayed on the instructional director card. Note, for example, in FIG. 1, the face 10 of the card displays a plurality of series of numbers 12. Series of numbers 12 are displayed on opposite ends of the card for good observation from opposite ends of a playing surface. Note further that in each array of numbers 12, one number 14 is circled, the purpose of which will be described hereinafter.

Figure 2:
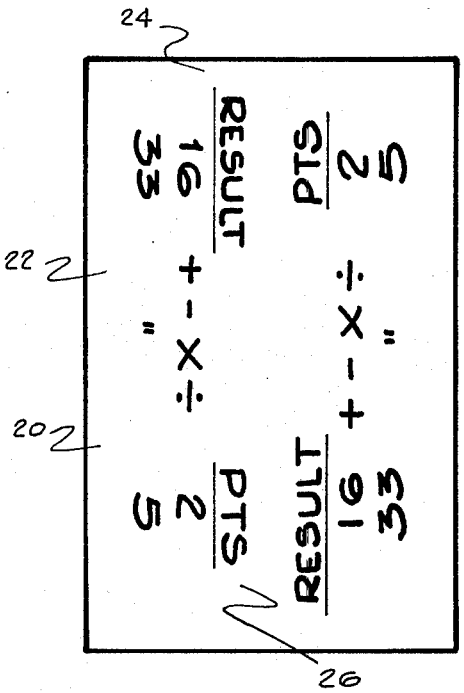
FIG. 2 is an opposite side of a playing card as illustrated in FIG. 1.

FIG. 2 depicts the underside 20 of the card director where the operators to be utilized for the round are identified as 22. Further, results are presented in columns 24 with the results 16 and 33 being listed by way of example. In conjunction with the result column 24, a point value column 26 is provided with a point value being presented for each result. In column 26, note for example, that a result of 16 carries a point value of 2 while a result of 33 carries a point value of 5. In certain arrangements as may be illustrated by FIGS. 1 and 2, results have been predetermined to be impossible when using the numbers 12 and operators 22 displayed on the card. As mentioned above, however, in the event that one randomly selects the numbers corresponding to those in a series 12 as listed on the face 10 of the card, the number in the circle is deleted and another randomly selected number is substituted therefor. This will assure that one of the results 24 will be possible with the numbers selected. Utilizing these particular randomly selected numbers then, and the operators 22 provided, a participant strives to achieve one of the two results listed on the underside 20 of the director. Should a participant derive a mathematical equation having a result of 33 as illustrated in FIG. 2, he would be awarded a point value of 5.

Figure 3:
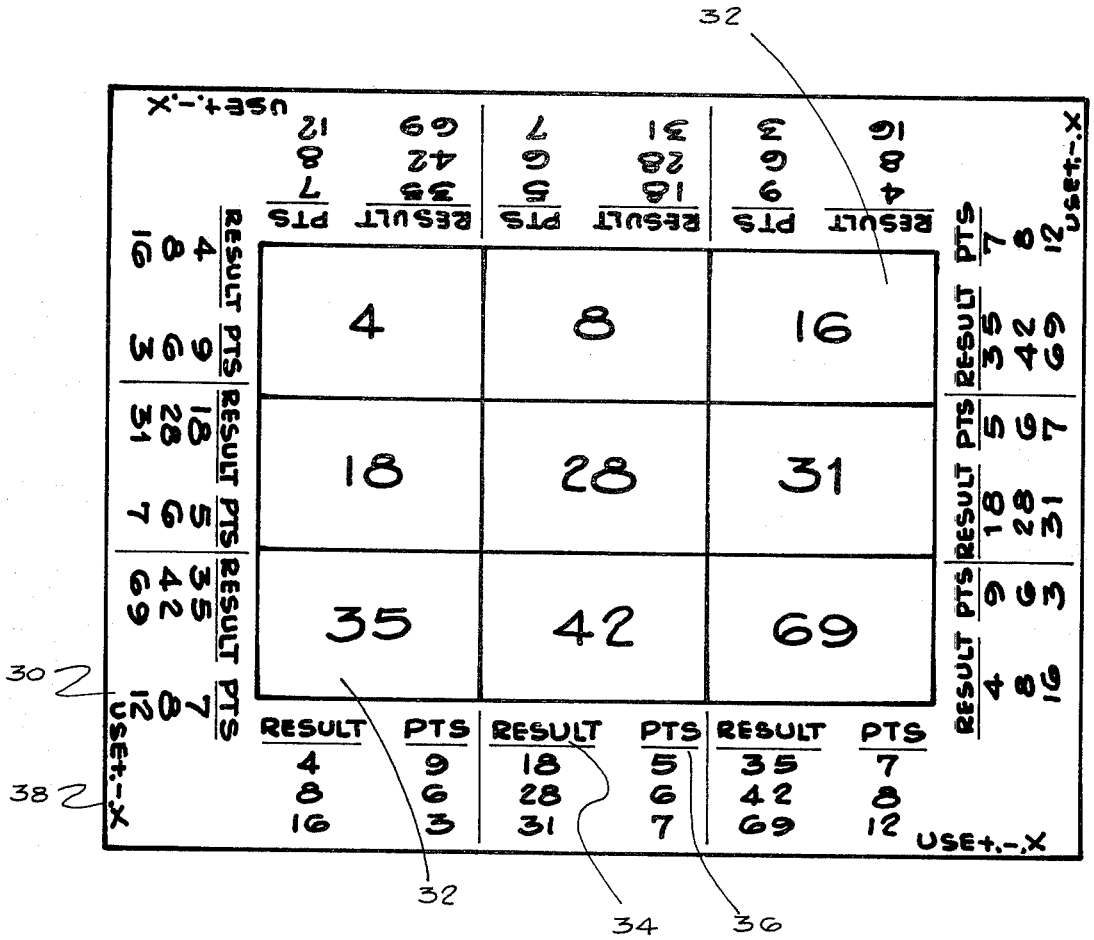
FIG. 3 is a further variation of an instructional director means according to the present invention.

A further embodiment of the instructional director is a card 30 as may be seen in FIG. 3. Director 30 displays a plurality of results 32 in a central portion thereof, with result and point columns 34 and 36 respectively being provided along each of the four sides of the director card. Likewise, the operators 38 to be employed are displayed on each of the four sides along with result and point columns 34 and 36. For this particular instructional director, the array of four numbers to be utilized is completely randomly selected. Otherwise, the use of the particular array of numbers and the operators 38 to achieve a desired result 32, would be the same as described for the cards of FIGS. 1 and 2. In other words, according to the arrangement of FIG. 3, a participant utilizing an array of four randomly selected numbers and the operators: add, subtract and multiply to achieve an equation with a result of four should be awarded nine points.

Figure 4:
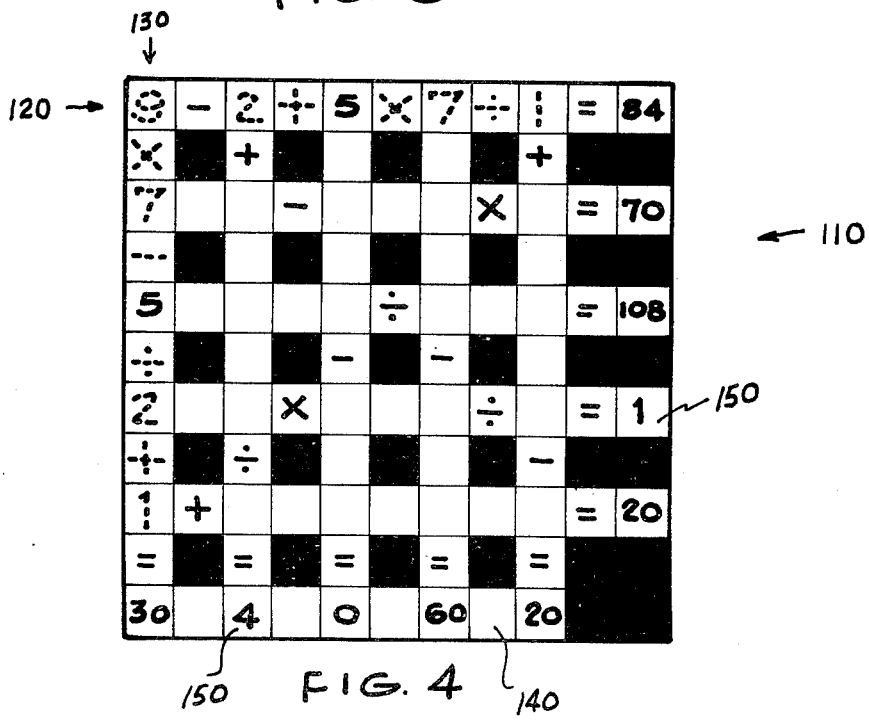
FIG. 4 is an illustration of a further embodiment of the game of the present invention.

Yet a further variation or adaptation of the game of the present invention is illustrated in FIG. 4. FIG. 4 shows a block 110 having a series of horizontal and vertical rows 120 and 130 respectively. Each row has a plurality of rectangles 140 therealong. On alternate, horizontal and vertical rows, a predetermined result 150 is provided. Additionally, in certain of the rectangles 140, a number or a mathematical operator may be provided as displayed in solid lines. These numbers and/or operators may be displayed by an instructional director as well. Thereafter, given a certain array of numbers and a further array of mathematical operators, a participant can complete the puzzle such that horizontal and vertical results are both attained. This version can be played by one participant as does a participant in a crossword puzzle, or by several participants competing to determine who derives the highest number of equations, or who derives the equations with the highest (or lowest) total sum of results, and the like. While FIG. 4 illustrates every other line in both vertical and horizontal directions to have an equation, all or any number of the lines may be designed for equation derivation.

Computation solutions for the individual rectangles are illustrated in broken lines. The cross number puzzle of FIG. 4 is thus similar to a crossword puzzle through horizontal and vertical cooperation. Note, for example, in the top horizontal line, in the second, fifth, tenth and eleventh rectangles from the left, a minus sign, a five, an equals sign and a result, 84, respectively are provided. Given the numbers 1, 2, 5, 7 and 9 in conjunction with the operator signals, addition, subtraction, multiplication and division, one can arrange the numbers and operators as further illustrated in the broken lines along the top horizontal line such that the equation $(9-2+5)\times7\div1=84$ is formed. Likewise, in the left hand vertical column, one sees the equation, $(9\times7-5)\div2+1=30$. The remainder of the puzzle would be completed in like fashion preferably using the same numbers and operators. The arrangement shown in FIG. 4 is further illustrative of a game board where the individual rectangles may be considered as element receiving areas. Individual elements may then be placed over the rectangles to derive the desired equation. Likewise, similar game boards may be provided for each variation of the game where the individual elements may be accomplished on the board to derive the equation.

Figure 5:
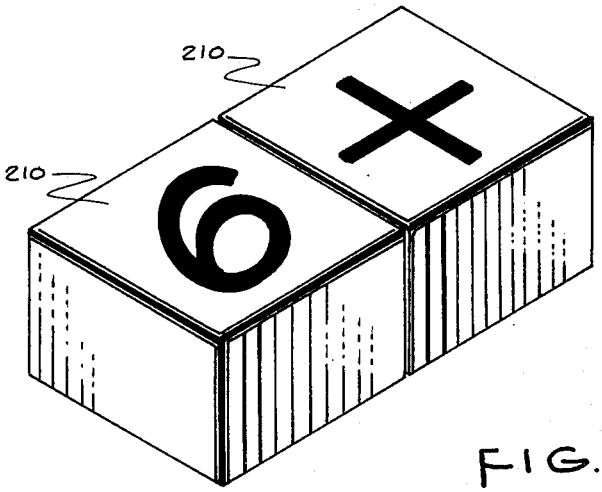
FIG. 5 is a schematic view of two elements that may be utilized in playing the game of the present invention.
Figure 6:
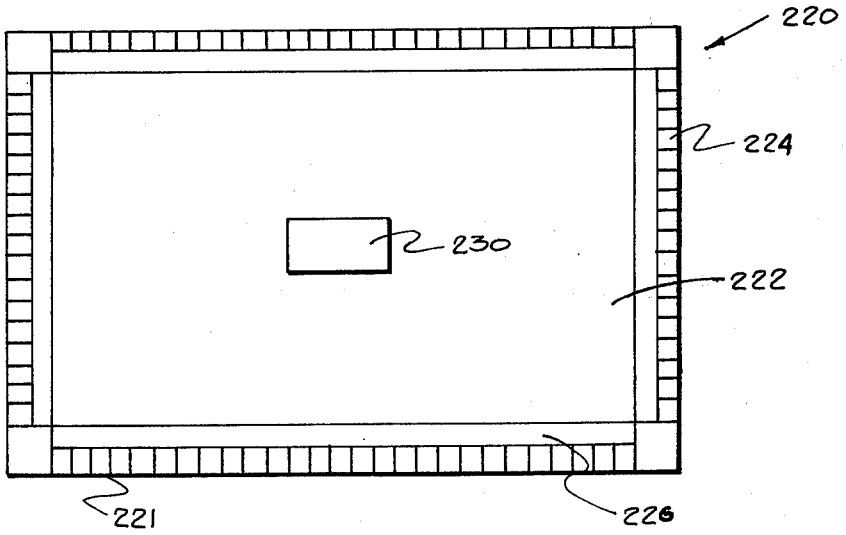
FIG. 6 is a schematic presentation of a playing board according to the present invention.

FIGS. 5 and 6 illustrate a game board embodiment of the present invention. Note in FIG. 5 a pair of elements 210 each of which is rectangular in shape and capable of abutting one another. One element 210 is shown with the number 6 thereon while the other element 210 has an addition operator sign. A game board 220 as shown in FIG. 6 may also be provided with a central portion 222 capable of receiving the informational director 230. Sides 221 of board 220 have element receiving areas 224 for receipt of player elements 210. Proper manipulation of the elements will then display the equation derived by the participant. While element receiving areas 224 are shown as small partitioned areas, a long slot may suffice along which the elements 210 may slide. Element storage areas 226 are also provided to receive and hold the player elements 210 until needed. Preferably element receiving areas 224 and storage areas 226 are located on all four sides of game board 220 whereby each of four participants has his own element storage and display area. Since any number of participants may play the game of the present invention, certainly a game board 220 may be produced with a different surface and arrangement of the element receiving and storage areas.

In one embodiment of the game of the present invention, an instructional director also displays the number of possible solutions for selected number combinations. Results are categorized and each category is assigned a particular point value to be awarded for a solution in that category. Point value elements may thus be provided and placed on the playing surface. As a participant derives an equation, he removes the designated point value element for that equation. A single equation can be used only once per round. After all point value elements are removed, the round is complete.

In practicing the present invention, and playing the games described by same, fractions and negative results are preferably avoided both for interim and final computations. In making an equation, it is preferred that an assumption is made that each operator applies to the interim result of all previous operations. Any desired construction rules would be suitable, however. Moreover, it should be pointed out that informational directors other than a card may be suitable.

Having described the present invention in detail, it is obvious that one skilled in the art will be able to make variations and modifications thereto without departing from the scope of the invention. Accordingly, the scope of the present invention should be determined only by the claims appended hereto.

What is claimed is:

1. A numerical computation game comprising:

a. a master board, said board having a plurality of player positions provided thereon, each player position having a plurality of means thereat for receiving playing elements thereat, said master board further having master sheet receiving means thereon;

b. a plurality of master sheets for use by all players receivable at said master sheet receiving means on said master board, each of said master sheets having first indicia means thereon illustrating a plurality of mathematical results and second indicia means thereon adjacent said first indicia means and illustrating a game award for each mathematical result;

c. a first set of a plurality of playing elements for each player, each of said first set of playing elements being receivable at said element receiving means on said master board, and having indicia means thereon illustrating a mathematical operator; and d. a second set of a plurality of playing elements for each player, each of said second set of playing elements being receivable at said element receiving means on said master board and having indicia means thereon illustrating an integer, whereby each player may position certain of his first and second sets of playing elements at element receiving means on said master board in a particular arrangement such that indicia means on said elements illustrate a mathematical equation whose result is illustrated by indicia means on one of said master sheets.

2. A numerical computation game as defined in claim 1 wherein said master sheets additionally have third indicia means thereon illustrating mathematical operators for use therewith.

3. A numerical computation game as defined in claim 1 wherein said master sheets has third indicia means thereon illustrating a plurality of integers to be used in achieving said results, whereby a player would select only the playing elements having identical integers thereon for use in achieving said result.

4. A numerical computation game comprising:

a. a master board, said board having a plurality of player positions provided thereon, each player position having a plurality of means thereat for receiving playing elements, said master board further having master sheet receiving means thereon;

b. a plurality of master sheets for use by all players receivable at said master sheet receiving means on said master board, each of said master sheets having first indicia means thereon illustrating a plurality of mathematical results and second indicia means illustrating a plurality of integers to be used by a player in producing an equation that realizes one of the results illustrated by said first indicia means;

c. a first set of a plurality of playing elements for each player, each of said first set of playing elements being receivable at said element receiving means on said master board, and having indicia means illustrating a mathematical operator; and d. a second set of a plurality of playing elements for each player, each of said second set of playing elements being receivable at said element receiving means on said master board and having indicia means thereon illustrating an integer, whereby each player may position certain of his first and second sets of playing elements at his said element receiving means on said master board in a particular arrangement such that indicia means on said elements illustrate a mathematical equation whose result is illustrated by indicia means on one of said master sheets.

* * * * *